US006886724B2

(12) United States Patent
Hung

(10) Patent No.: US 6,886,724 B2
(45) Date of Patent: May 3, 2005

(54) REMOVABLE COVER PIECE FOR BELT BUCKLE

(76) Inventor: Yun-Tung Hung, P.O. Box No. 6-57, Chung-Ho, Taipei 235 (TW)

( * ) Notice: Subject to any disclaimer, the term of this patent is extended or adjusted under 35 U.S.C. 154(b) by 76 days.

(21) Appl. No.: 10/406,553

(22) Filed: Apr. 4, 2003

(65) Prior Publication Data

US 2004/0195281 A1 Oct. 7, 2004

(51) Int. Cl.[7] ..... A44B 11/00

(52) U.S. Cl. ..... 224/163; 40/640; 224/152; 224/183; 224/576; 224/903; 224/930

(58) Field of Search ..... 224/152, 163, 224/183, 576, 903, 930; 40/640; 24/163 R, 163 K, 303; 368/278; 968/351, 398, DIG. 1

(56) References Cited

U.S. PATENT DOCUMENTS

| | | | | | |
|---|---|---|---|---|---|
| 1,429,641 | A | * | 9/1922 | Sayko | 40/640 |
| 1,961,068 | A | * | 5/1934 | Mix | 33/355 R |
| 2,124,945 | A | * | 7/1938 | Gross | 368/278 |
| 2,316,225 | A | * | 4/1943 | De Hoffman et al. | 63/29.1 |
| 2,840,875 | A | * | 7/1958 | Chambers | 24/163 R |
| 3,063,118 | A | * | 11/1962 | Salter et al. | 24/303 |
| 3,136,547 | A | * | 6/1964 | Schaper | 24/303 |
| 3,208,123 | A | * | 9/1965 | Koos | 24/303 |
| 3,969,836 | A | * | 7/1976 | DuBois | 24/163 K |
| 4,052,773 | A | * | 10/1977 | Nesbitt | 24/163 K |
| 4,502,188 | A | * | 3/1985 | Kohli | 24/163 K |
| 4,536,094 | A | * | 8/1985 | Nagura | 368/278 |
| 4,556,932 | A | * | 12/1985 | Lehrer et al. | 362/103 |
| 4,715,839 | A | * | 12/1987 | Ford et al. | 24/163 K |
| 4,753,377 | A | * | 6/1988 | Poluhowich | 224/163 |
| 5,102,023 | A | * | 4/1992 | Nguyen | 224/163 |
| 5,379,493 | A | * | 1/1995 | Wu | 24/163 K |
| 6,098,252 | A | * | 8/2000 | Woerth, Jr. | 24/163 R |
| 6,182,388 | B1 | * | 2/2001 | Patton | 40/640 |
| 6,597,281 | B1 | * | 7/2003 | Thomas | 24/163 R |

FOREIGN PATENT DOCUMENTS

| | | | | |
|---|---|---|---|---|
| GB | 2020539 A | * | 11/1979 | 24/163 K |
| GB | 2088617 A | * | 6/1982 | |

* cited by examiner

*Primary Examiner*—Gary E. Elkins
(74) *Attorney, Agent, or Firm*—Troxell Law Office, PLLC

(57) ABSTRACT

The invention herein relates to a removable cover piece for belt buckle which is devised in two parts: a buckle head and a cover piece where the buckle head has a recessed trap precisely dimensioned to receive the cover piece. A nail grip is devised at the open end of the recessed trap so that the multi-functional cover piece inlayed in the trap can easily be gripped, removed or replaced with another cover piece. Upon the recessed trap contact faces are several magnet elements to meet the opposing magnet elements on the cover piece in order to secure the cover piece into the recessed trap. The present invention also features two slide guides at the base of recessed trap contact faces in response to the slide edges on the base of the cover pieces to form a track fitting assembly relationship, further securing the multi-functional cover pieces.

2 Claims, 8 Drawing Sheets

REMOVABLE COVER PIECE FOR BELT BUCKLE

BACKGROUND OF THE INVENTION

1) Field of the Invention

The invention relates to an improvement to a removable cover piece of belt buckle wherein provisions are made for a variety of miniature electronics product such as radio, miniature flash light, electronics clock and etcetera, to be fitted to add new conveniences and economical value to the conventional belt buckle.

2) Description of the Prior Art

As advancing technologies gaining a secure place in the consumers market, personal items such as belt buckles are often designed to combine with new electronics products that include foot steps counter, clock, radio and etcetera.

The aforementioned invention of the electronics product/belt buckle combination usually devises the electronic product into a cover piece to attach to the belt buckle such as the case of Taiwan Patent Registration Number 087216074 wherein even though the patent invention greatly improves the functionality of an ordinary belt buckle, it is inconvenient to use. In the case of an electronic clock attached to the buckle, the user is first to open the cover piece at 90 degrees to the buckle whereupon the user is to bend down to look at the buckle (See FIG. 4 of Patent Registration No. 087216074). Not only is it inelegant for the user to glance down that way, to be in that posture frequently may cause discomfort or even injury to the neck vertebrate. In addition, said patent invention needs to have the buckle remove to change batteries; causing great inconveniences to disassemble and to reassemble the item. The complete set of parts are large in number and intricate in making, thus uneconomical to stock material, to manufacture and to use.

Another conventional invention of buckles with additional fixture is to devise the attachment permanently inlayed into the buckle as one unit, enhancing the functionality of a conventional buckle. Nevertheless such device causes inconveniences when the attached items are the likes of miniature light fixture, race watch, key that need to be manipulated freely while being used, contradicting the purpose of belt buckles. Also, this conventional invention shares the problems of a cumbersome procedure when it comes to change batteries. The two conventional inventions of belt buckle attachment are both in need of fundamental improvement to be viable market attractions.

The Applicant, fully aware of the deficiencies of these conventional inventions, undertakes the task through numerous studies and experiments to complete a product of a removable cover piece to belt buckle that eliminate the deficiencies of these conventional inventions.

SUMMARY OF THE INVENTION

The invention herein is to devise the belt buckle into two separable parts: a buckle head and a cover piece where the buckle head is made with a recessed trap precisely dimensioned to receive the cover piece. A nail grip is devised at the open end of the recessed trap so that when the multi-functional cover piece is inlayed in the trap it can easily be gripped, removed or replaced with another cover piece. Upon the recessed trap contact faces are several magnet elements to meet the matching magnet elements on the cover piece in order to secure the cover piece into the recessed trap. The present invention also features two slide guides at the base of recessed trap contact faces in response to the slide edges on the base of the cover pieces to form a track fitting assembly relationship, further securing the multi-functional cover pieces. Again, the nail grip at the open end of recessed trap allows the easy removal of the cover pieces.

The present invention aims to truly provide a versatile, multi-purposes belt buckle cover piece with enhanced convenience and added economical value.

BRIEF DESCRIPTION OF THE DRAWINGS

To enable a further understanding of the said objectives and the technological methods of the invention herein, the brief description of the drawings below is followed by the detailed description of the preferred embodiments.

DETAILED DESCRIPTION OF THE PREFERRED EMBODIMENT

Figure 1:
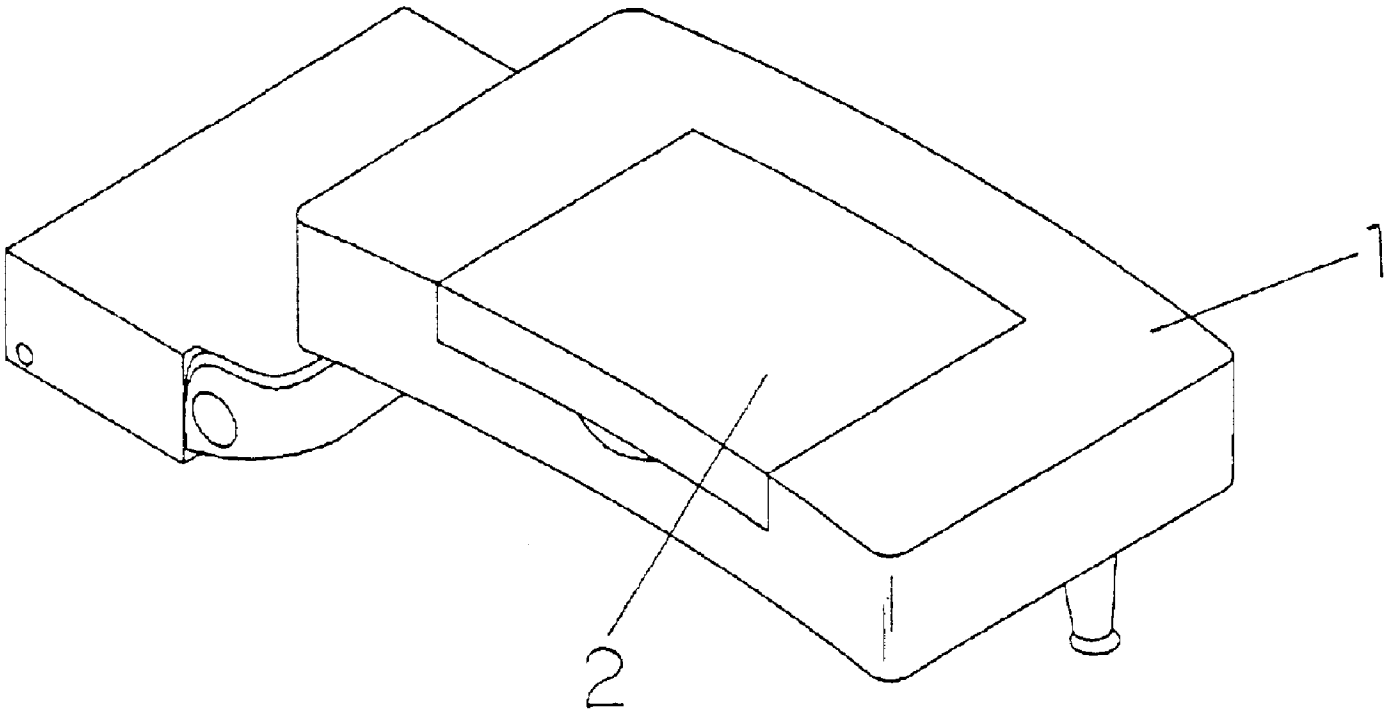
FIG. 1 is a perspective view showing a ready assembled embodiment of the present invention.
Figure 2:
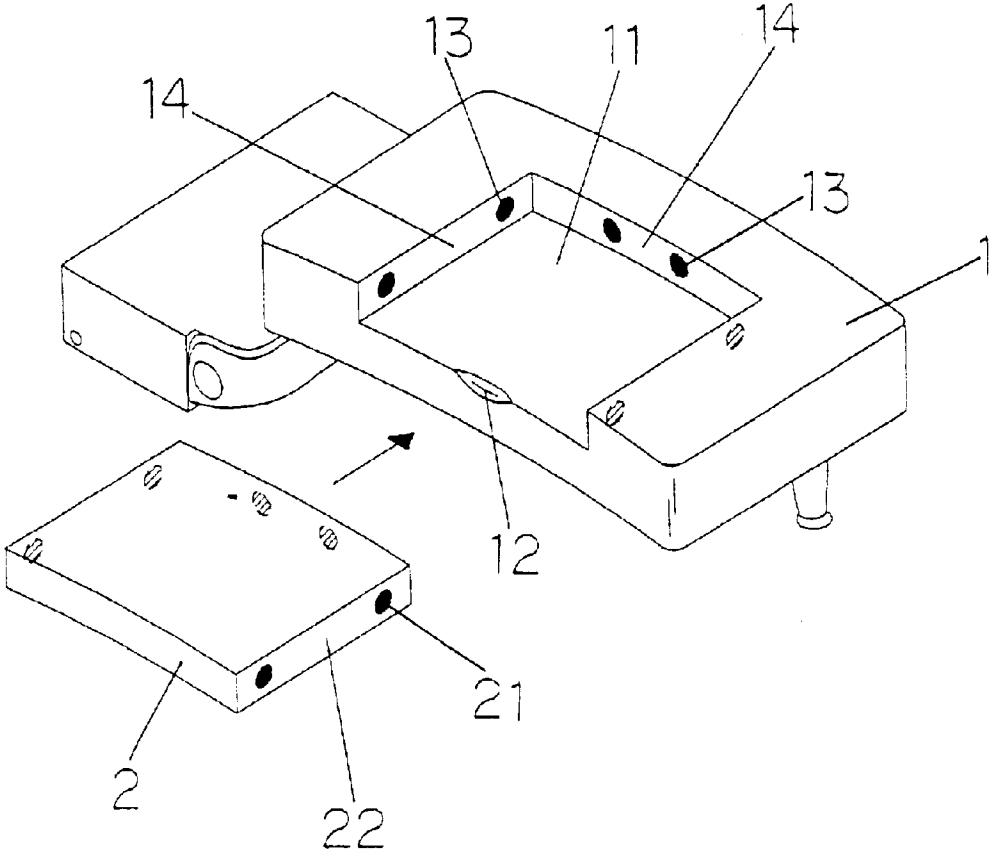
FIG. 2 is a perspective exploded view showing a cover piece in detached condition from the buckle head of the present invention.

To fully illustrate the function, structure and characteristic of the present invention the following preferred embodiments are selected in drawing forms to assist the explanation:

Referring to FIGS. 1 and 2, a perspective and exploded views showing the completed assembly and the separate components of the present invention, comprises of a separate buckle head (1) and a multi-function cover piece (2) where the buckle head (1) is fitted with a recessed trap (11), precisely dimensioned to receive the insertion of the cover piece (2) wherein the open end of the recessed trap (11 ) has a nail grip (12) for the easy gripping and removal of cover piece (2). The corresponding contact faces (22) (14) of cover piece (2) and recessed trap (11) are each installed with matching magnet elements (13) in order to secure cover piece (2) seated in the recessed trap (11).

Figure 3:
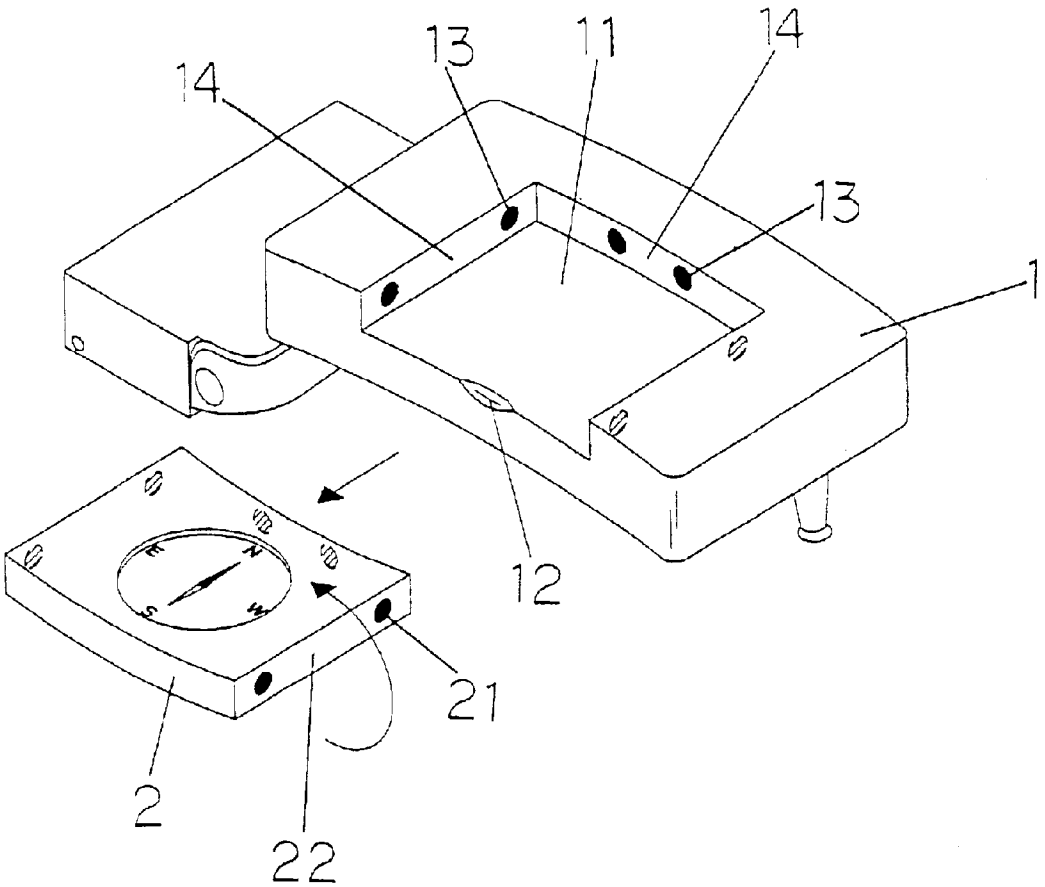
FIG. 3 is a perspective exploded view showing the preferred embodiment (a cover piece with an inlayed clock) of the present invention.
Figure 4:
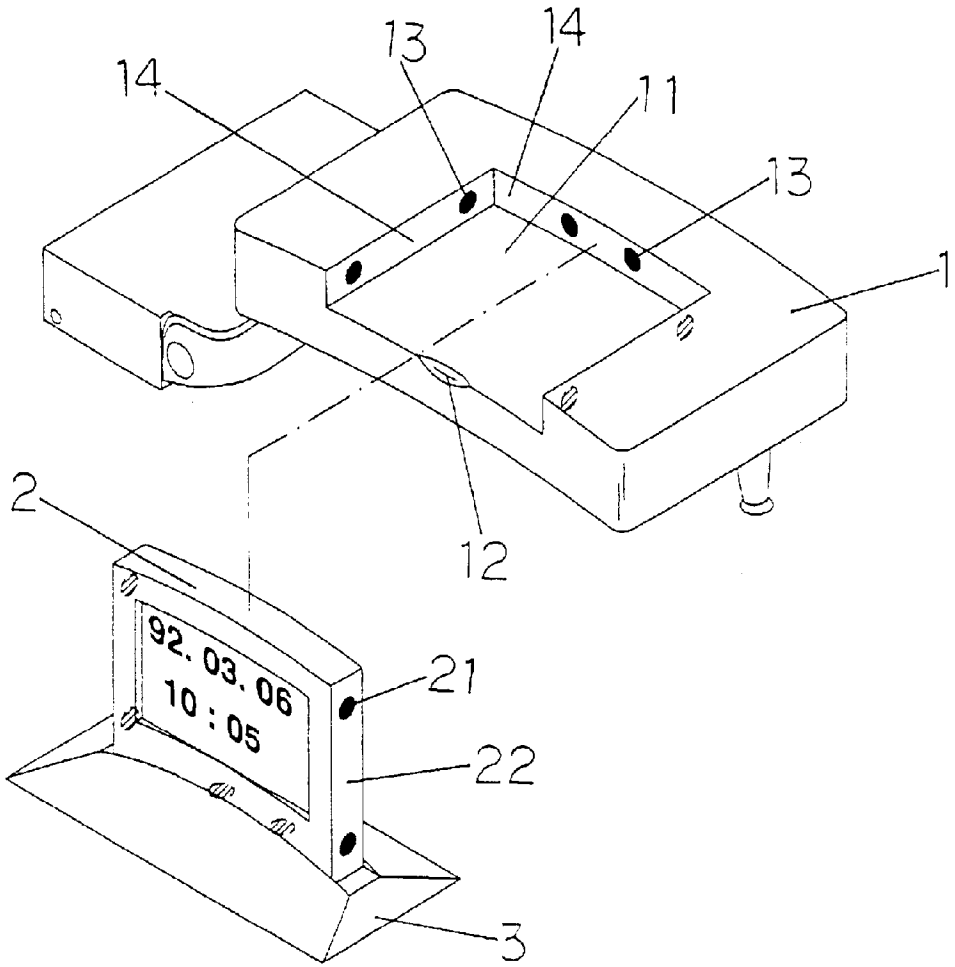
FIG. 4 is another perspective view showing a preferred embodiment (a cover piece with an inlayed clock) of the present invention.

As stated previously, the cover piece (2) can be applied to the embodiment of a radio, miniature flash light, timer, foot steps counter, race watch, key, Compass, alarm, electronic clock and etcetera. When in the case of electronic clock, as illustrate in FIG. 3, the clocks contact face (22) has magnet (dot or stripe) elements (21) to match the opposing magnet elements (13) on the contact faces (14) of recessed trap (11), of the buckle head (1). It is only necessary to pull the cover piece (2) at the nail grip (12) to detach it from the recessed trap (11) for a glance of the time, and then return the cover piece (2) back to the recessed trap (11) to restore the belt buckle's integrity. It is not necessary for a user to glance down to look at the clock in an uncomfortable and unnatural posture. The electronic clock/cover piece (2) can also to be temporarily removed to sit on a base seat (3) as a table clock (see FIG. 4) then return to the recessed trap (11) when it is not needed.

Figure 5:
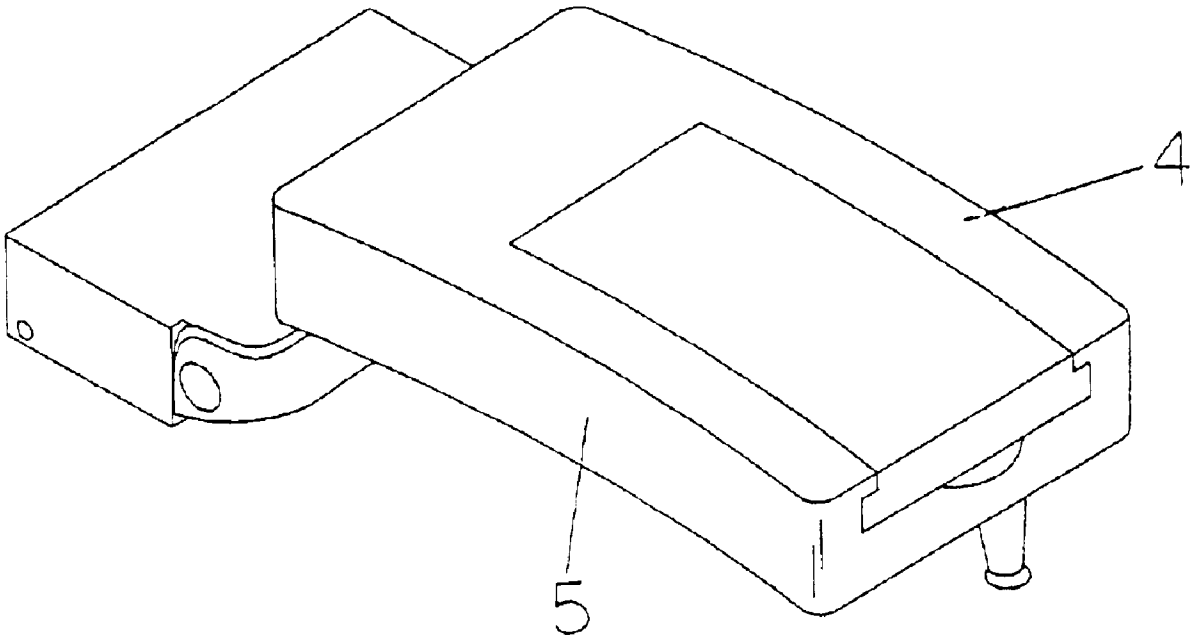
FIG. 5 is a perspective view showing another ready assembled embodiment, with the open end at a different orientation, of the present invention.
Figure 6:
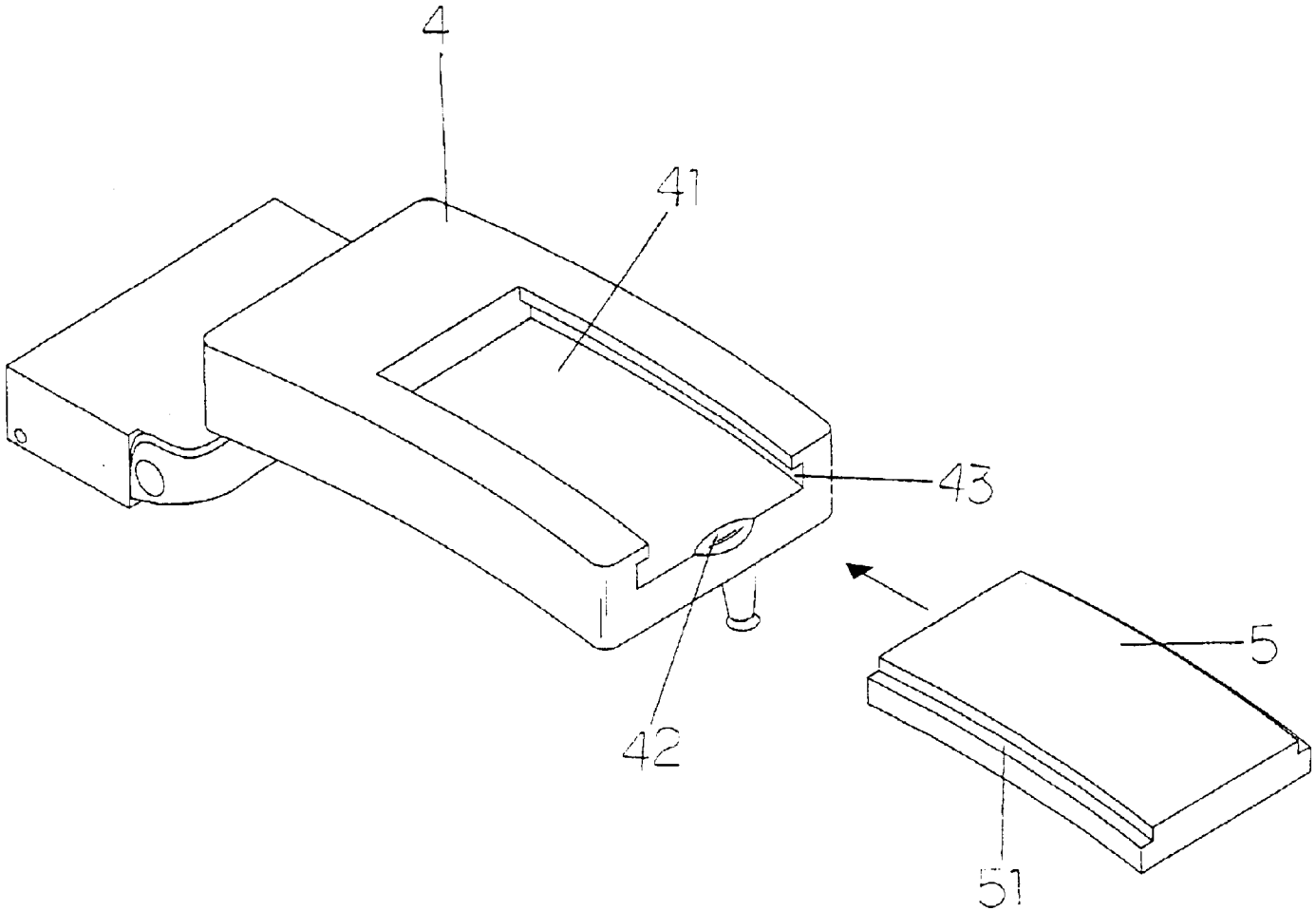
FIG. 6 is a perspective view showing another ready disassembled embodiment, with the open end at a different orientation, of the present invention.

Referring to FIGS. 5 and 6 for the perspective and exploded views of showing the completed assembly and the separate components of another embodiment of the present invention, comprises of a separate buckle head (4) and a multi-function cover piece (5) while the buckle head (4) is fitted with a recessed trap (41), precisely dimensioned to receive the insertion of the cover piece (5) wherein the open end of the recessed trap (41) has a nail grip (42) for the easy gripping and removal of cover piece (5). The base of recessed trap (41) side walls is formed into a slide guide (43) corresponds to the slide edge (51) of the cover piece (5), constituting a slide track assembly to secure the cover piece (5).

Figure 7:
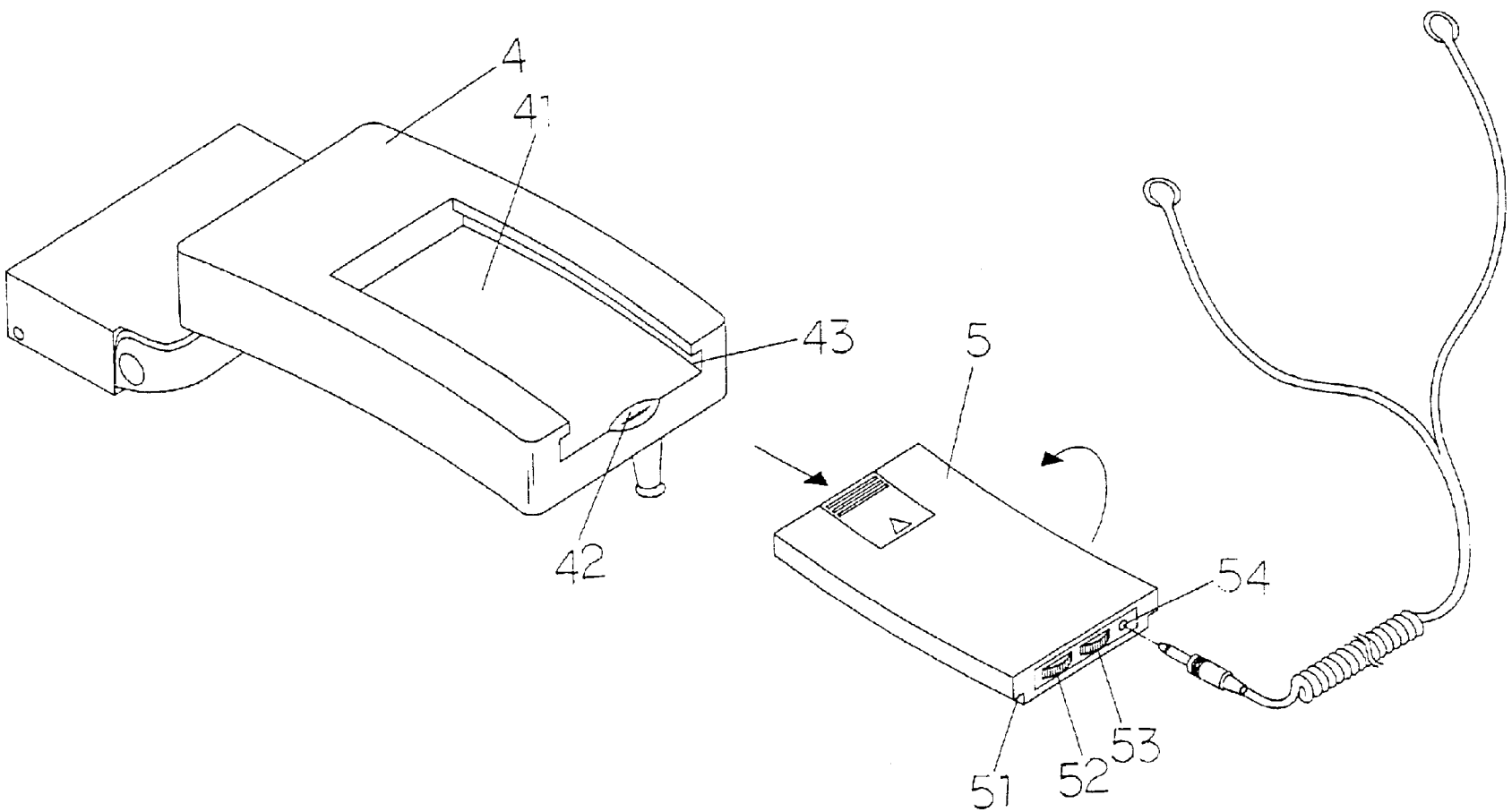
FIG. 7 is a perspective view showing the disassembled embodiment with a radio as the cover piece where the volume/tuning controls and the ear phone jack all pointed to the open end, of the present invention.

When a radio is selected to fit the cover piece (5) as shown in FIG. 7, the slide edges (51) on either sides of the radio are to fit along the slide guides (43) on either side walls of the recessed trap (41), of the buckle head (4) to anchor the radio inlayed in the recessed trap (41). The tuning and volume controls or earphone plug are all pointed at the open end of recessed trap (41). Changing batteries is made possible by pulling out the cover piece (5) while catching the nail grip (42), instead of having to remove and open the entire belt buckle assembly. After the new batteries are inserted, simply reverse the above steps to restore the belt buckle to normal condition.

Figure 8:
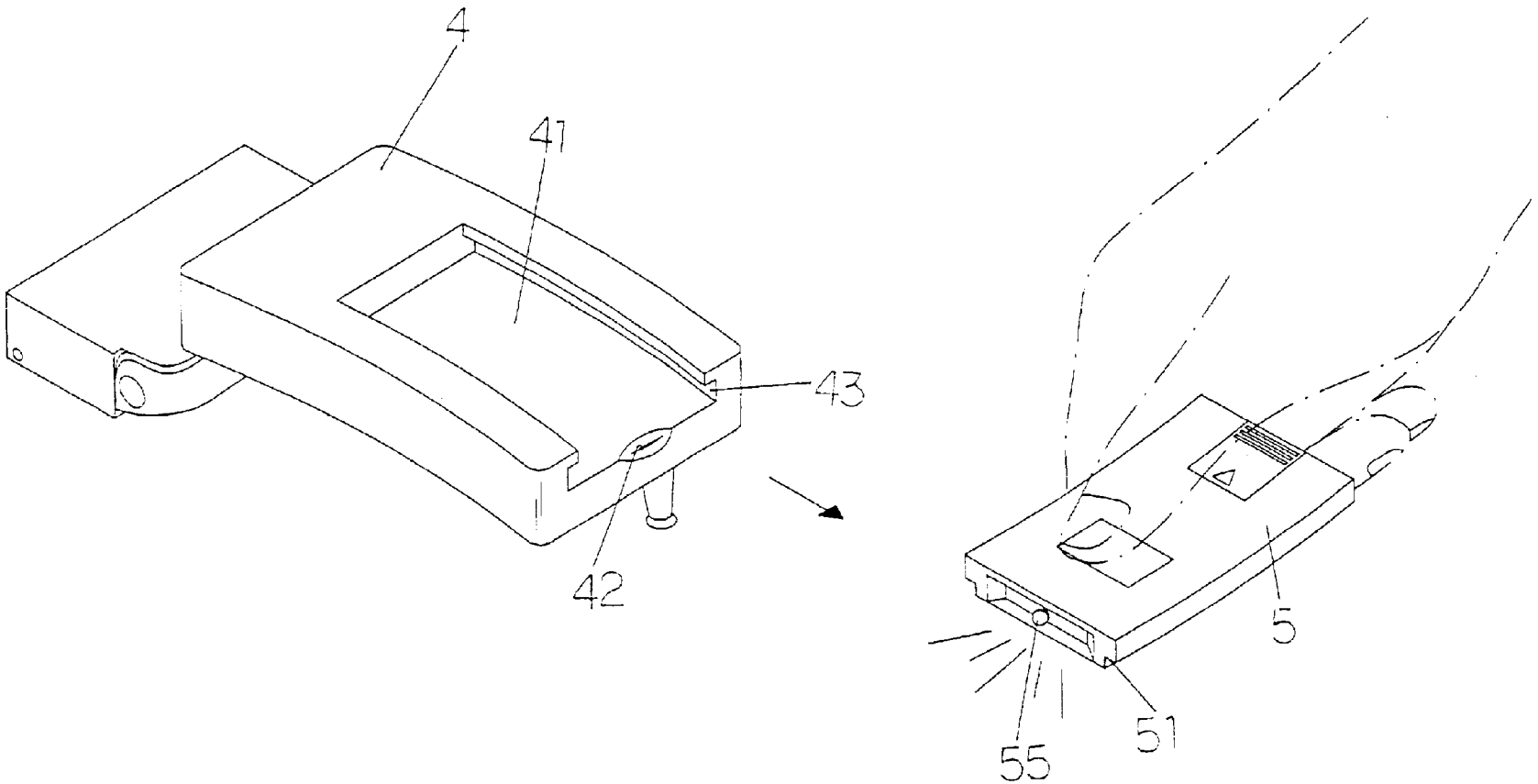
FIG. 8 is a perspective view showing the disassembled embodiment with a miniature flash light as the cover piece while the light bulb pointed to the open end, of the present invention.

When a miniature flash light is selected to fit the cover piece (5) as shown in FIG. 8, the slide edges (51) on either sides of the cover piece (5) are to fit along the slide guides (43) on corresponding side walls of the recessed trap (41), of the buckle head (4), to anchor the miniature flash light inlayed in the recessed trap (41). A light bulb (55) is pointed at the open end of recessed trap (41). When the miniature flash light is needed to illuminate a direction or an object, it is only a matter of removing the cover piece (5) by catching on at the nail grip (42) of the recessed trap (41) instead of having to remove the entire belt buckle. Similarly, the miniature flash light is returned into position after use with same little effort.

To summarize the above explanations, the present invention features a versatile convenience and a practical economical value. The above illustrated device is indeed capable of achieving the stated goal and effectiveness, and it has never been disclosed in any previous publications or example of existing practices. The Application is submitted on this ground and your consideration is much appreciated It is to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A belt buckle comprising:

a removable cover piece and a buckle head, said buckle head having a recessed trap sized to receive said cover piece and a nail grip at an open end of said trap to assist removing the cover piece from the trap;

said cover piece and buckle head are formed with corresponding contact faces, wherein said contact faces include matching magnet elements in one of dot and stripe form to securely anchor the cover piece within the trap.

2. The belt buckle of claim 1, wherein said cover piece comprises a device selected from a group of devices consisting of a radio, a miniature flash light, a timer, a foot step counter, a race watch, a key, a compass, an alarm and an electronic clock.

* * * * *